US005604483A

United States Patent [19]

Giangardella et al.

[11] Patent Number: 5,604,483

[45] Date of Patent: Feb. 18, 1997

[54] PORTABLE PERSONAL SECURITY DEVICE

[76] Inventors: John J. Giangardella, 3 Calle Del Apice, San Clemente, Calif. 92672; Procopio Soriano, Jr., 6 Belinder Rd., Gaithersburg, Md. 20878

[21] Appl. No.: 385,480

[22] Filed: Feb. 8, 1995

[51] Int. Cl.[6] ..... G08B 13/00

[52] U.S. Cl. ..... 340/565; 250/353; 250/DIG. 1; 340/546; 340/567; 340/574; 340/628; 340/693

[58] Field of Search ..... 340/565, 567, 340/574, 693, 628, 528, 546, 328; 250/342, 353, DIG. 1

[56] References Cited

U.S. PATENT DOCUMENTS

| | | | |
|---|---|---|---|
| 2,810,902 | 10/1957 | Crossley | 340/521 |
| 4,052,716 | 10/1977 | Mortensen | 340/552 |
| 4,319,228 | 3/1982 | Daniels | 340/521 |
| 4,377,808 | 3/1983 | Kao | 340/527 |
| 4,447,726 | 5/1984 | Mudge et al. | 250/342 |
| 4,451,734 | 5/1984 | St. Jean et al. | 250/353 X |
| 4,535,240 | 8/1985 | Vigurs | 250/342 |
| 4,672,206 | 6/1987 | Suzuki et al. | 250/342 |
| 4,716,402 | 12/1987 | Francis | 340/693 |
| 4,729,635 | 3/1988 | Saferstein et al. | 359/804 |
| 4,746,906 | 5/1988 | Lederer | 250/353 X |
| 4,851,814 | 7/1989 | Rehberg | 340/546 |
| 4,853,542 | 8/1989 | Milosevic et al. | 250/353 |
| 4,882,567 | 11/1989 | Johnson | 340/522 |
| 4,960,995 | 10/1990 | Newmann et al. | 250/347 |
| 5,128,654 | 7/1992 | Griffin et al. | 340/567 |
| 5,221,919 | 6/1993 | Hermans | 340/567 |
| 5,309,145 | 5/1994 | Branch et al. | 340/540 |
| 5,311,024 | 5/1994 | Marman et al. | 250/353 |
| 5,440,292 | 8/1995 | Bedrosian | 340/567 |

FOREIGN PATENT DOCUMENTS

| | | | |
|---|---|---|---|
| 2207241 | 1/1989 | United Kingdom | 340/567 |

*Primary Examiner*—Thomas Mullen
*Attorney, Agent, or Firm*—Daniel L. Ellis

[57] ABSTRACT

A portable, battery operated personal alarm and motion detector has two passive infrared (PIR) elements for sensing motion in two corresponding and oppositely directed fields of view, with each field of view being easily and selectably variable during set-up. A rotatable turret is associated with each PIR element and has several windows such that each window is selectably alignable with the PIR element by manual rotation of the turret. Each of the windows is provided with a lens or lens cluster which, when aligned with the PIR element, defines a different field of view in which motion is detectable by that element. An integrally and pivotally attached base member provides a support by which the device can be tilted to, and maintained in, a selectable orientation for purposes of aiming. Different modes of operation are selectable, including a manually armed alarm mode in which the person carrying the device only needs to depress a panic button in order for the device to emit a high decibel alarm. The device also is programmable with a personal code so that only a person knowing the code can instantly reset or disable the alarm. A preferred embodiment of the alarm also includes an integral smoke detector.

20 Claims, 5 Drawing Sheets

Fig. 2
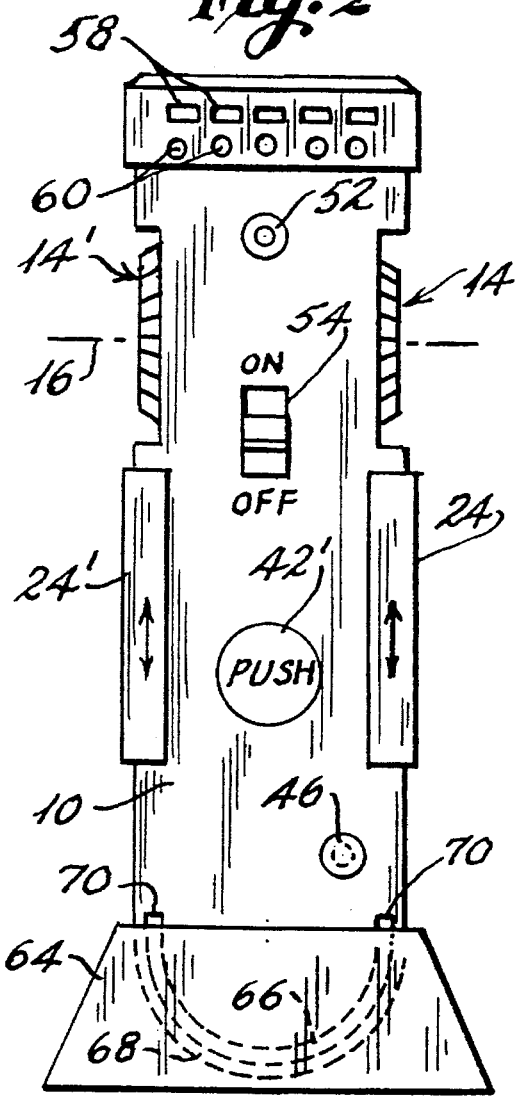
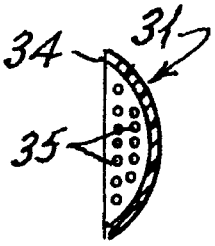
Fig. 4
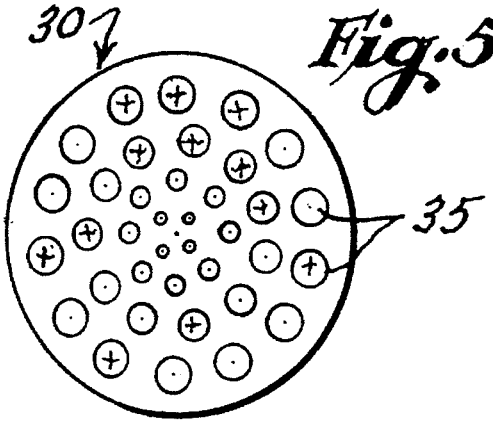
Fig. 5
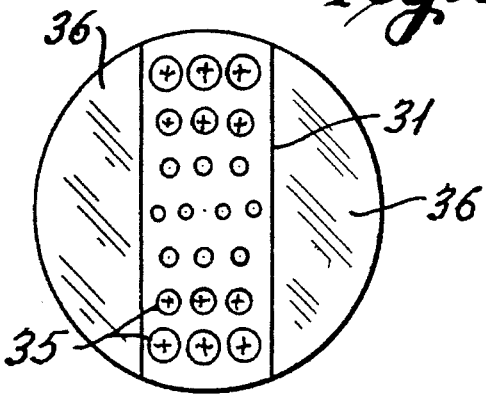
Fig. 6
Fig. 3
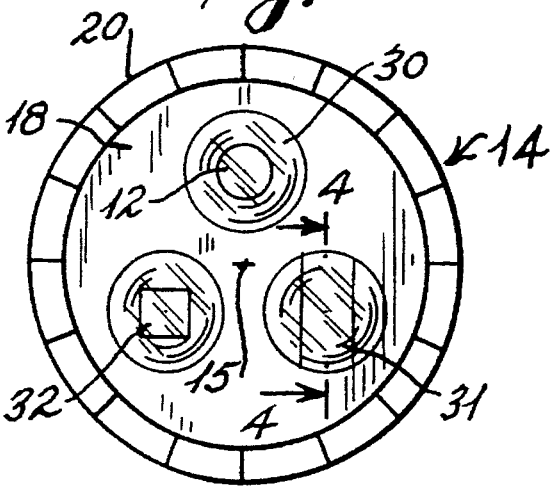
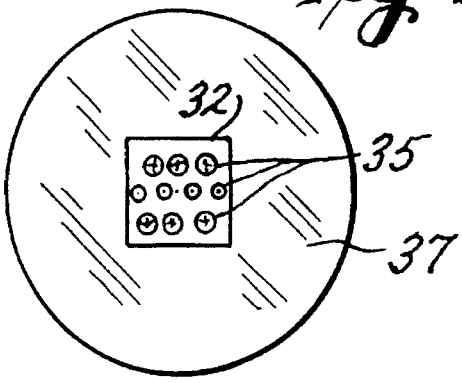
Fig. 7

PORTABLE PERSONAL SECURITY DEVICE

U.S. PATENT CROSS-REFERENCES TO THE PRIOR ART

U.S. Pat. No. 2,810,902 issued Oct. 22, 1957 to Crossley entitled FIRE AND INTRUSION DETECTOR SYSTEM;

U.S. Pat. No. 4,052,716 issued Oct. 4, 1977 to Mortensen entitled FIRE AND INTRUDER DETECTION AND ALARM APPARATUS;

U.S. Pat. No. 4,319,228 issued Mar. 9, 1982 to Daniels entitled PORTABLE INTRUSION ALARM;

U.S. Pat. No. 4,377,808 issued Mar. 22, 1983 to Kao entitled INFRARED INTRUSION ALARM SYSTEM;

U.S. Pat. No. 4,447,726 issued May 8, 1984 to Mudge et al. entitled PASSIVE INFRARED INTRUSION DETECTOR;

U.S. Pat. No. 4,535,240 issued Aug. 13, 1985 to Vigurs entitled INTRUDER DETECTION;

U.S. Pat. No. 4,672,206 issued Jun. 9, 1987 to Suzuki et al. entitled PASSIVE INFRARED DETECTOR;

U.S. Pat. No. 4,729,635 issued Mar. 8, 1988 to Saferstein et al. entitled HAND-HELD MICROSCOPE;

U.S. Pat. No. 4,882,567 issued Nov. 21, 1989 to Johnson entitled INTRUSION DETECTION SYSTEM AND A METHOD THEREFOR;

U.S. Pat. No. 4,960,995 issued Oct. 2, 1990 to Newmann et al. entitled RADIATION DETECTOR;

U.S. Pat. No. 5,128,654 issued Jul. 7, 1992 to Griffin et al. entitled PRESET LIGHT CONTROLLER INCLUDING INFRARED SENSOR OPERABLE IN MULTIPLE MODES;

U.S. Pat. No. 5,309,145 issued May 3, 1994 to Branch et al. entitled TRAVEL CONVENIENCE AND SECURITY DEVICE;

U.S. Pat. No. 5,311,024 issued May 10, 1994 to Marman et al. entitled LENS ARRANGEMENT FOR INTRUSION DETECTION DEVICE.

The disclosures of all prior art referred to herein is intended to be expressly incorporated, by reference thereto, into the instant disclosure.

BACKGROUND OF THE INVENTION

The invention relates generally to a battery operated device which is particularly useful in a hotel room, as well as at home, for detecting motion and/or smoke and sounding an alarm in response thereto. The inventive device also relates to portable, personal security alarms which are easily held in the hand of a user during walking or jogging and readily actuatable by the user in order to sound the alarm in an emergency or threatening situation.

To the inventor's knowledge, U.S. Pat. No. 5,309,145 is the closest prior art to a combination of features provided by the instant invention. As specified hereinafter, the instant invention provides several important improvements over the prior art.

Thus, it is an object of the invention to provide such a device which is particularly adapted for use while traveling or in apartments, dormitories and other locations where another alarm system may or may not be present.

And it is an object of the invention to provide such a device which can be carried in a handbag or briefcase and can be easily set-up and supported on a dresser, nightstand, door, window, floor or the like in order to detect an intruder.

More particularly, it is an object of the invention to provide the user with the ability to select a mode of operation in which motion can be sensed within either or both of two generally oppositely directed fields of view.

Also, it is an object of the invention to provide for aiming the field(s) of view by tilting the device to a particular angle relative to a support surface and maintaining that angle of tilt for motion detecting.

Additionally, it is an object of the invention to provide for easy manual selection and adjustment of each field of view.

Still another object of the invention is to provide that each motion sensing element has several lenses or lens clusters associated therewith and integrally attached to the device so as to be manually shiftable into alignment with the motion sensing element in order to selectably modify the corresponding field of view.

Further, it is an object of the invention to provide a rotatable turret corresponding to each field of view, with each turret having several windows in each of which are supported a lens or lens cluster so that manual rotation of the turret allows selection and alignment of a particular window with a motion sensing element. In so doing, the field of view of each lens of the cluster can overlap, or not, with a field of view of one or more of the other lenses of the cluster so as to result in a sensor field of view which is uniquely patterned according to the cluster of lenses mounted in a selected window of the turret.

Still further, it is an object of the invention to provide at least one panic button for actuating the personal alarm and to provide a user selectable and settable code for instantly disabling a high decibel alarm and resetting and rearming the device. Thus, the device can be reset and rearmed by depressing the panic button a particular number of times and/or in a particular pattern according to that code.

Also, it is an object of the invention to provide that this coded reset feature is useable in motion detecting modes of operation of the device.

Additionally, it is an object of the invention to provide the device with a separately actuatable smoke detector operatively associated with the high decibel alarm.

Furthermore, it is an object of the invention to provide for selecting between the high decibel output and a lower audio output similar to that of the typical beepers or pagers.

A preferred embodiment of the invention meets all of the above, as well as other, objects of the invention and provides for selective actuation of various modes of operation, as will be apparent from a complete reading of the instant disclosure.

SUMMARY OF THE INVENTION

A portable, battery operated personal alarm and motion detector has two passive infrared (PIR) elements for sensing motion in two corresponding and oppositely directed fields of view, with each field of view being easily and selectably variable during set-up. A rotatable turret is associated with each PIR element and has several windows such that each window is selectably alignable with the PIR element by manual rotation of the turret. Each of the windows is provided with a lens or lens cluster which, when aligned with the PIR element, defines a different field of view in which motion is detectable by that element. An integrally and pivotally attached base member provides a support by which the device can be tilted to, and maintained in, a selectable orientation for purposes of aiming. Different modes of operation are selectable, including a manually armed alarm mode in which the person carrying the device only needs to depress a panic button in order for the device to emit a high decibel alarm. The device also is programmable with a personal code so that only a person knowing the code can instantly reset or disable the alarm.

The novel features which are considered to be characteristic of the invention are set forth in particular in the appended claims. However, the construction and method of operation of the invention, together with additional objectives and advantages thereof, will be understood better from the remaining disclosure when read in conjunction with the accompanying drawings.

Like items of construction are given like numbers throughout the drawings, and each variation or modification of an item of construction is numbered differently from the other.

BRIEF DESCRIPTION OF THE DRAWINGS

FIG. 2 is a side elevation of the preferred construction, from which is can be seen that the motion detector can detect motion in oppositely directed fields of view.

FIG. 3 is an elevational view of the manually rotatable turret for varying the field of view, illustrating the relationship of the windowed turret to one of the motion sensing elements.

FIG. 4 is an enlarged cross-section of one lens cluster of the turret as viewed generally in the direction of arrows 4—4 in FIG. 3.

FIGS. 5–7 are enlarged elevational views of each of the lens clusters of the turret of FIG. 3.

DETAILED DESCRIPTION OF THE INVENTION

Figure 1:
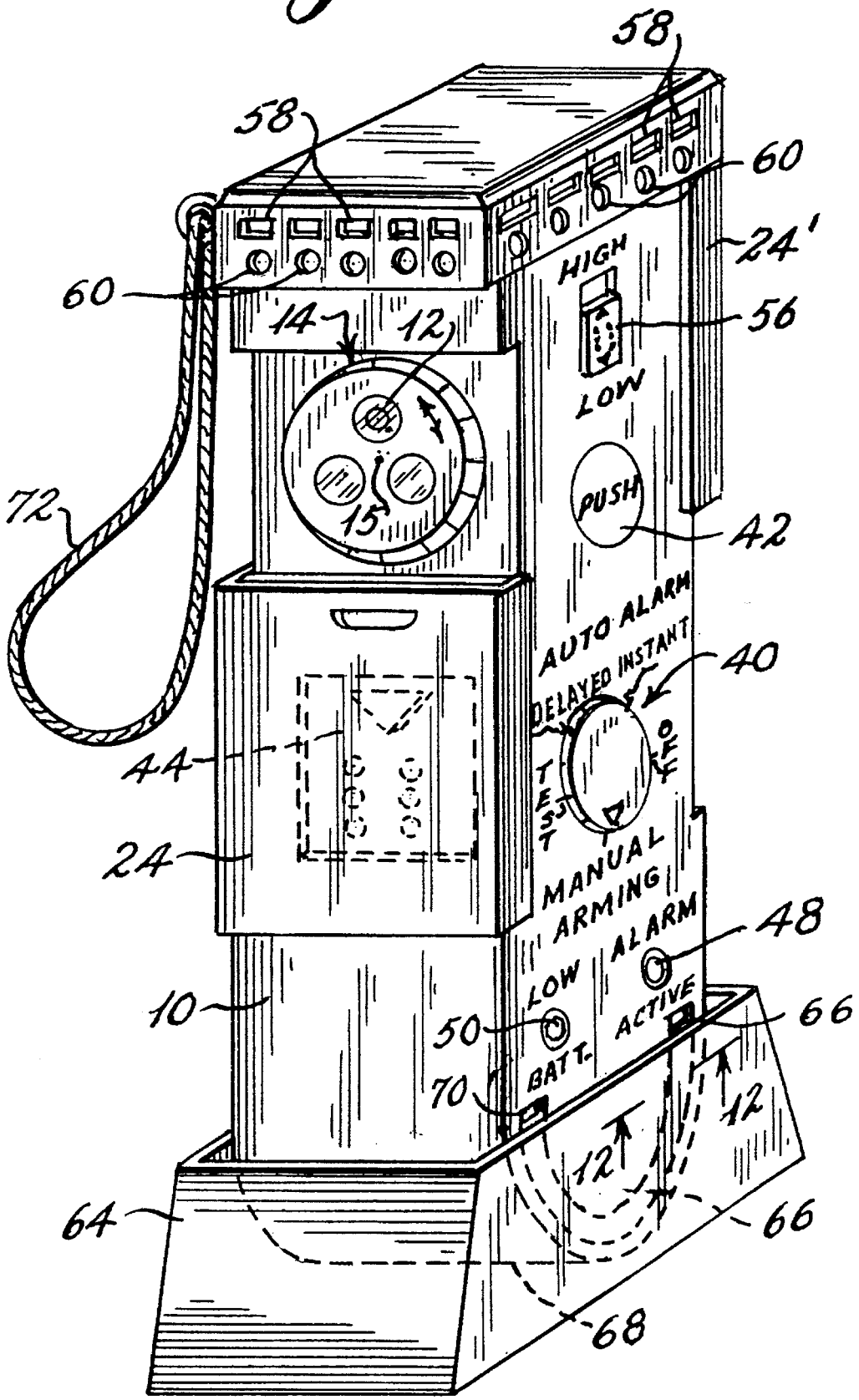
FIG. 1 is an isometric view of a preferred embodiment of the invention.

Referring to FIGS. 1 and 2, the preferred embodiment of the invention includes a housing 10 having turret assemblies 14, 14' which are situated on opposite faces of housing 10. These turrets 14, 14' provide for manual variation and control of the fields of view of a pair of corresponding motion sensing elements 12, 12'. Covers 24, 24' each are slidable up and down (as viewed in FIGS. 1 and 2) and, when closed, provide physical protection for the turret assemblies 14, 14' and prevent motion detection by elements 12, 12'.

With reference to FIGS. 3–7, turret 14 has a disc-shaped surface 18 with three different windows 30, 31, and 32 for controlling the field of view of motion sensing element 12. The windows 30–32 are separately and selectively alignable with motion sensing element 12 by rotating turret 14 about point 15. The periphery of turret 14 is knurled at 20 in order to facilitate manual gripping and rotation of turret 14.

Preferably, each of the windows 30–32 includes a cluster of focusing lenses 35, with each lens cluster serving to define a corresponding field of view and, when aligned with sensor 12, to focus radiation from that field of view onto sensor element 12. Each lens cluster has a spherically curved substrate 34 (best seen in FIG. 4) supporting an array of lenses 35 which can be of various sizes, types, and/or optical properties. Each lens 35 of the cluster can be molded and/or ground with selected optical properties and as a unitary part of the curved (or, alternatively, a generally planar) substrate 34, and the substrate 34 can be rigid or flexible as each case requires.

Lens clusters in general are previously known, and the reader is referred to U.S. Pat. No. 5,311,024 for a better understanding of the construction and functionality of one type of lens cluster. Each lens of the reference cluster has a field of view which may or may not overlap with the field of view of another lens of the cluster. In this reference, selected lenses of the cluster are masked in order to selectively vary the field of view of the associated sensor element.

In the instant invention, it is contemplated that such masking may or may not be used, depending upon the focusing of all or selected ones of the lenses of a cluster. As an alternative to masking, each lens of the cluster can be customized so that the field of view of each cluster is defined by a pattern of separate, overlapping or non-overlapping fields of view of the individual lenses of the cluster.

Examples of differences between the lens clusters of windows 30–32 may be seen by reference to FIGS. 5–7. The lens cluster 31 in FIG. 6 is masked at 36 so as to block passage of radiation therethrough and, thus, narrow the field of view of the sensor 12. Still further limiting of the lens cluster 32 and reduction of the corresponding field of view can be provided by masking 37, as seen in FIG. 7. Alternatively, individual lenses of the cluster can be fabricated in well known manner so as to accomplish the same field of view provided by such masking.

Although not illustrated herein, it is contemplated that other masking and/or focusing patterns are possible, as needed, and that turret 14 could include a greater number of windows. Also, it is contemplated that a window could have only a single lens mounted therein or that all but a selected one of the lenses 35 in substrate 34 could be masked in order to control and define a corresponding field of view.

In the preferred embodiment, the motion sensor for each field of view is the passive infrared (PIR) type, either a singular element as in U.S. Pat. No. 4,447,726, or a paired element as described in U.S. Pat. Nos. 4,882,567 and 4,377,808. Typically, the PIR element detects movement within its field of view by sensing temperature radiation variations and/or movement within the field of view.

By using two oppositely directed motion sensors in the same housing, separate areas can be separately focused and monitored at the same time. As an example, a hotel guest may wish to limit motion detection to the door of the room and an oppositely disposed window, while allowing freedom of movement in other parts of the room. According to the masking on a particular lens cluster, it is possible to define generally oppositely directed fields of view within which either or both of these surfaces can be monitored without an extension of axis 16 intersecting either the door or the window. As may be appreciated, there are other instances where it may be desirable to limit the field of view in at least one direction, and the invention provides a means for doing so.

Figure 12:
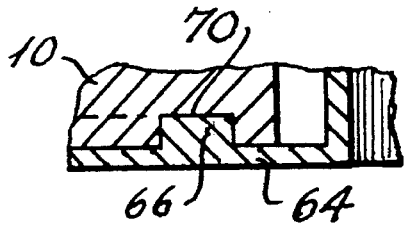
FIG. 12 is a cross-section, as viewed generally in the direction of arrows 12—12 in FIG. 1.

Additionally, it may be desirable to tilt the housing 10 for aiming and establishing a particular field of view for one of the sensors and not the other. To this end, the device has a curved bottom 68 extending into an integral base 64. Base 64 is provided with an arcuately extending flange 66 (as seen in FIG. 12) which is slidably engaged in a corresponding arcuately extending groove 70 formed in the housing 10, thus allowing tilting of housing 10 relative to the base 64 as constrained by the arcuate groove 70 and flange 66.

When tilting the housing in this manner to aim one of the motion sensors, for instance sensor element 12, it may be desirable to prevent motion sensing by the other sensor element 12', and this can be accomplished by sliding cover 24' over the turret 14'. As seen in the drawings, each turret 14, 14' can be covered by a corresponding cover 24, 24' so as to provide physical protection and to selectively prevent motion detection by one or both sensor elements 12, 12' as needed.

Alternatively or additionally, it is contemplated that turret 14 can be rotated so that sensor 12 is covered by a portion of turret surface 18 which is generally midway between adjacent windows, so as to totally block radiation sensing by the element 12.

Figure 8:
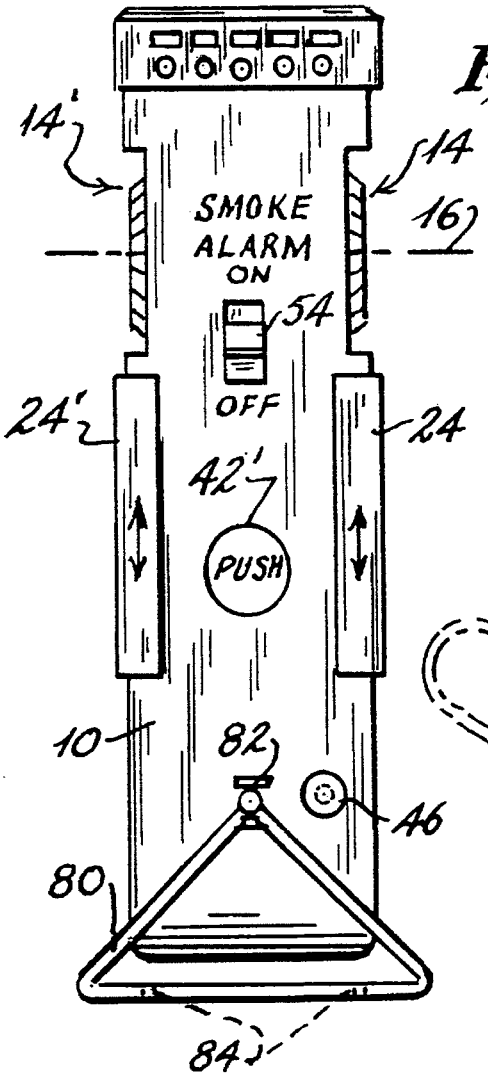
FIG. 8 is a side elevation, similar to that of FIG. 2, for illustrating an alternate embodiment by which the device can be maintained in a tilted position.

In a modification illustrated in FIG. 8, an auxiliary cradle 80 can be removably attachable to housing 10, in any well-known manner, in order to provide for and maintain tilting of housing 10 about pivot point 82 of the auxiliary cradle. Members 84 (in phantom) are cross-braces connecting opposite sides of cradle 80.

Figure 9:
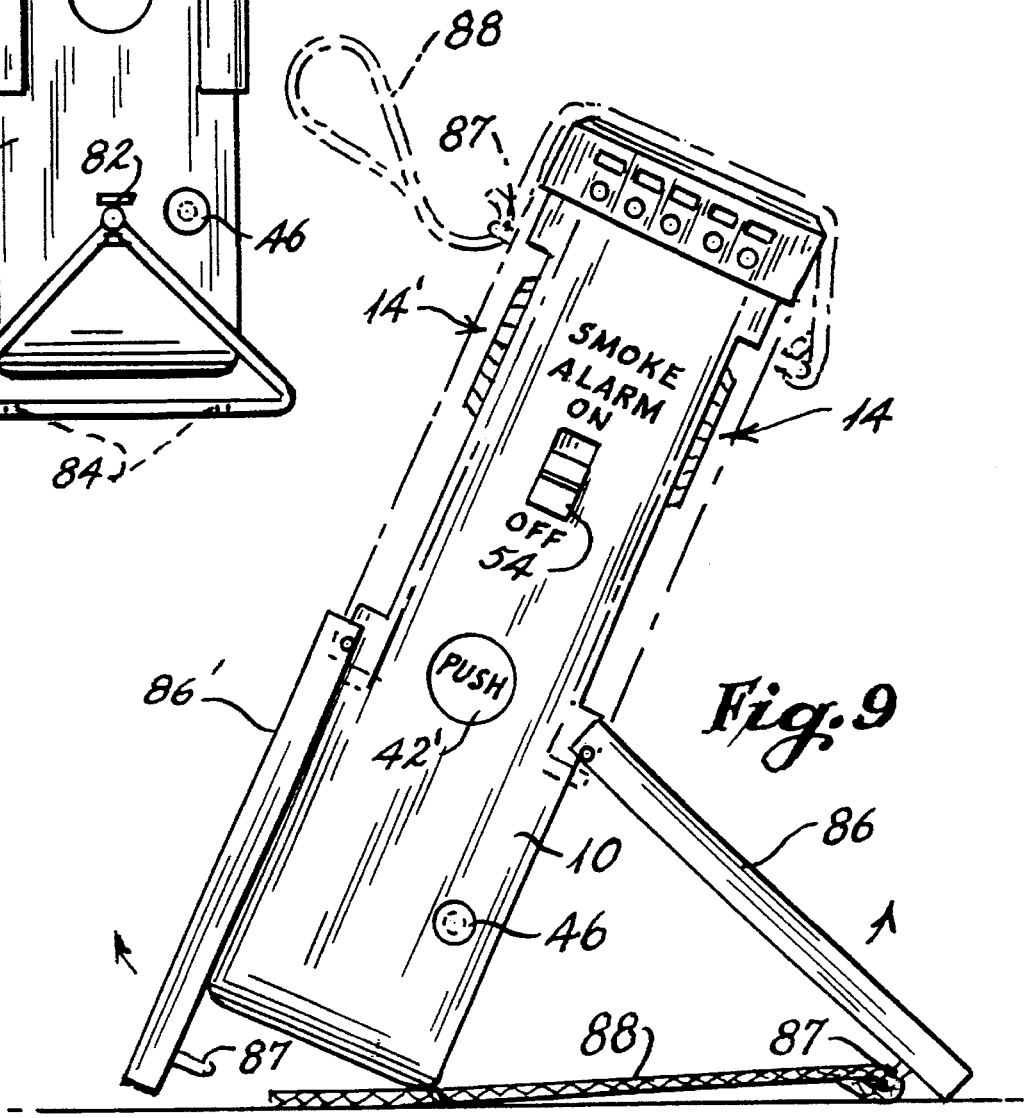
FIG. 9 illustrates still another embodiment by which the device can be maintained in a tilted position.

Another modification, illustrated in FIG. 9, provides hinged covers 86, 86', both of which can be opened as needed in order to uncover the respective turret assemblies 14, 14', with cover 86 being useable for stabilizing the housing 10 in the tilted condition of FIG. 9. To accomplish this, cover 86 has one end of a carrying strap 88 attached thereto and, when cover 86 is opened as illustrated, a free end of the strap 88 can be positioned between the housing 10 and the surface upon which it is supported. In this manner, a strap 88 having sufficient friction can maintain the housing in the selected, tilted position for establishing the field of view for turret assembly 14'. Of course, this open condition of cover 86 does not allow it to cover turret assembly 14 in order to prevent motion detection by corresponding sensor 12. Again, it is contemplated that turret assembly 14 can be rotated so that sensor element 12 is midway between two of the windows 30–31 in order to block the sensor by means of turret surface 18.

As indicated in phantom in FIG. 9, the free end of strap 88 can be passed over the top of housing 10 and threaded through a ring 87 on the other hinged cover 86' so that strap 88 maintains the closed position of covers 86 and 86' while carrying the device by strap 88.

Figure 10:
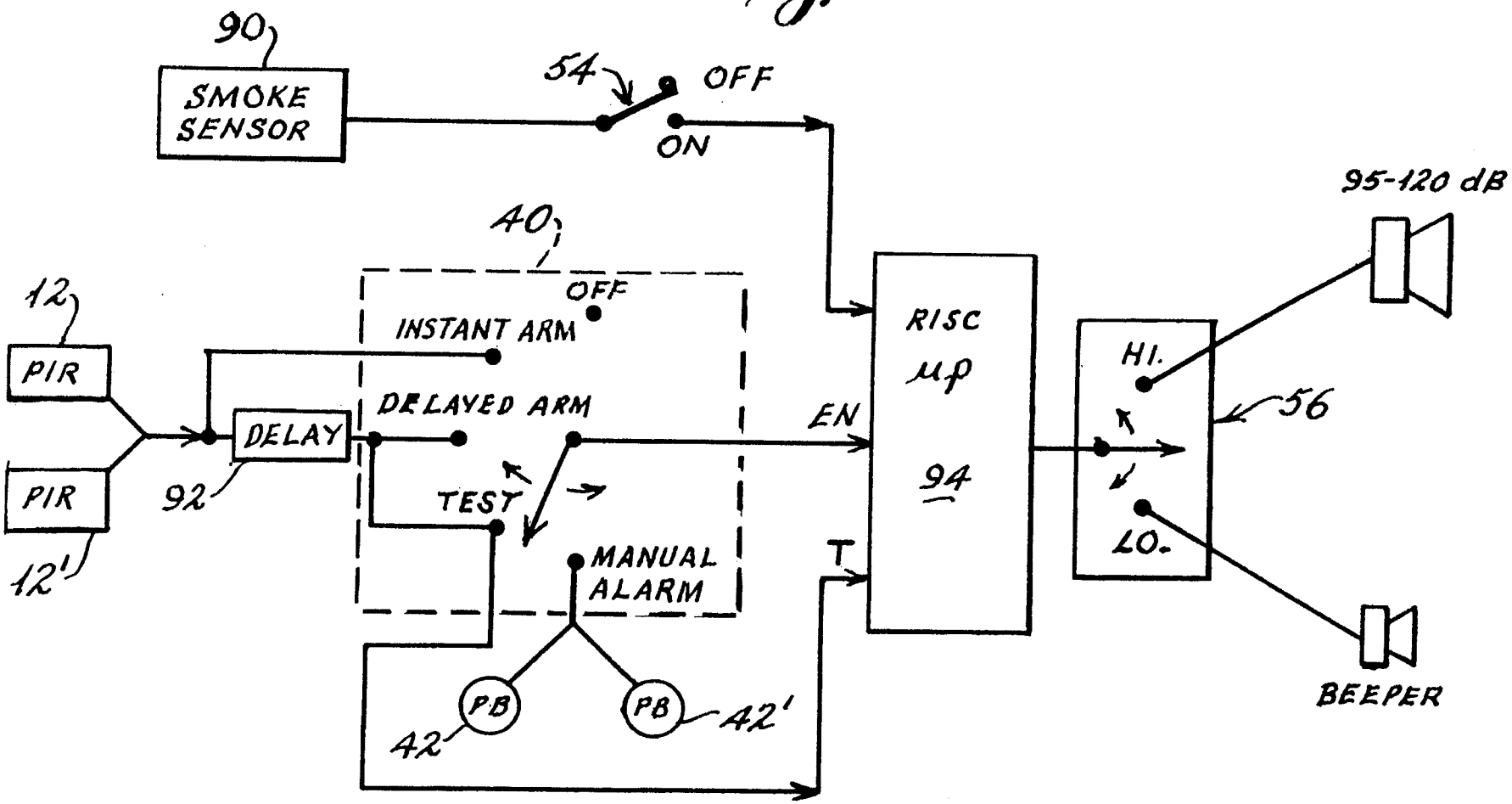
FIG. 10 is a schematic block diagram illustrating signal paths between various main portions of the device.

Various modes of operation of the device are selectable by means of a rotatable selector 40 illustrated in FIGS. 1 and 10. The modes selectable by member 40 include OFF, MANUAL, TEST, as well as the DELAYED and INSTANT alarm modes during which an alarm is automatically initiated in response to detected motion. LED 48 (FIG. 1) is lit whenever one of the MANUAL, TEST, DELAYED or INSTANT modes is active.

Figure 11:
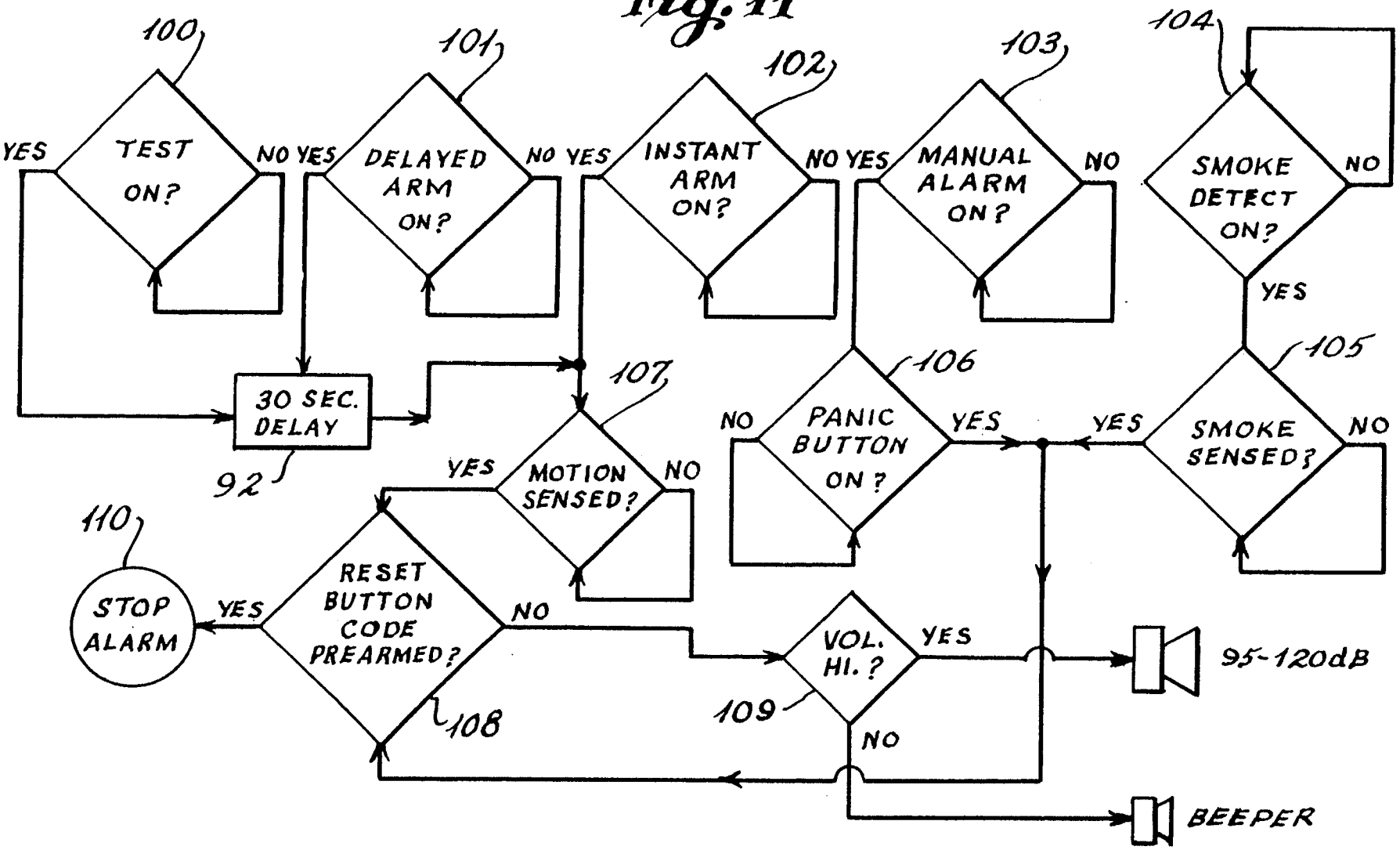
FIG. 11 is a schematic flow diagram for describing the functioning of the device.

Referring to FIGS. 10 and 11, selection of the TEST, DELAYED and INSTANT modes provides for an output to the volume selector switch 56 in response to motion detected by either of the PIR sensor elements 12, 12', while also providing delay device 92 for delaying initiation of the alarm (e.g., by 30 seconds) for the TEST and DELAYED modes of operation. Thus, when the device is armed and the user of the device enters the selected field of view, a sufficient amount of time is provided for the user to turn selector 40 to the OFF mode. Such a delay also allows the user to pass through the field of view and reset the device prior to the alarm going off, for instance when a user needs to maintain the device in an armed state when making a series of passes through his apartment door while unloading groceries from a car.

The MANUAL mode allows the user to manually initiate a loud alarm when presented with a personal emergency, as when confronted by a threatening situation during walking or jogging. To that end, panic buttons 42, 42' provide ready means for manually initiating the alarm when holding the device. When in this mode, depressing either panic button 42 or 42' causes the alarm to sound instantly.

The invention also provides that the user can actuate a predetermined code in order to instantly reset the device when in any of the modes of operation, thus preventing the alarm from being easily disabled by someone not knowing the code. The programmed "reset" code can be implemented by the user depressing one or both of the panic buttons a particular number of times (e.g., 3 times) in a short span of time.

It is also contemplated that the code may be manually and selectively set by the user in any of the well known security code entry methods and means, such as keypad entry.

Openings or grillwork at 58 facilitate audio output from one or more internally situated alarm sources, with the output volume being selective between high or low, e.g., 95–120 dB or the typical beeper volume, according to the situation of use and the desire of the user. In some instances it is desirable to limit the alarm volume to that of a typical beeper or the like, such as when testing the device. In another instance, a guest in his hotel room may want to monitor the return of a child to the room without setting off the high volume alarm. Two-position slide switch 56 allows the user to manually select between the two volumes of audio output. Alternatively or additionally, it is contemplated that the user could select that a visual indicator (LED or the like) would blink upon motion being detected.

Openings 60 in the top of housing 10 admit smoke to an internally situated smoke detecting element 90 (indicated in FIG. 10) of the standard type. Switch 54 (FIG. 2) allows separate energization of the smoke detector, and LED 52 gives indication of the ON state of the smoke detector.

Strap 72 is provided for the convenience of the user in carrying the portable personal security device, as by looping strap 72 around the user's wrist.

Panel 44 (indicated in phantom in FIG. 1) provides access to a compartment for batteries which are used to power the portable device. Additionally, a standard connector 46 allows connection of the device to a standard 120 volt AC receptacle via a typical AC to DC transformer providing a 9 volt DC or the like output. It also is considered to be within the scope of the invention to provide the device with a rechargeable power source internally of housing 10 and/or a retractable plug which can be mated with a standard outlet in order to recharge and/or power the device as needed. The preferred embodiment also includes a typical "low battery" detecting capability in which LED 50 illuminates to indicate such a state of that power source.

Thus, it will be seen that the objects set forth above, among those made apparent from the preceding description, are efficiently attained and, since certain changes may be made in the construction set forth without departing from the scope of the invention, it is intended that all matter contained in the above description or shown in the accompanying drawings shall be interpreted as illustrative and not in a limiting sense.

With this in mind, other structures for altering the fields of view are considered to fall within the scope of the invention. For instance, it is contemplated that several individual lenses and/or lens clusters can be moveable into coaxial, simultaneous alignment with a single detecting element in order that, together, they cooperate to define and control the field of view.

Further, for ease of aiming the device when setting it up, it is contemplated that visible light can be projected from the device to indicate each field of view parameter. To incorporate this feature into the device of the invention, it can be modified in any well known manner so as to include visible light projection as disclosed in any of the U.S. Pat. Nos. 4,447,726; 4,275,303; and 4,672,206.

Still further, it is considered to be within the scope of the invention to use a single PIR element for sensing motion in both of the oppositely directed fields of view, simultaneously. To this end, it is contemplated that any well known mirror system can be utilized to provide the input of both fields of view to the single PIR element.

It is to be understood also that the following claims are intended to cover all of the generic and specific features of the invention herein described, and all statements of the scope of the invention which, as a matter of language, might be said to fall therebetween.

We claim:

1. In an intrusion detector having a housing, means for sensing motion within at least one field of view and producing an output signal in response to said motion, means for emitting an alarm in response to said output signal from said sensing means, and means for controlling electrical operation of said intrusion detector, said field of view having a central axis, and the improvement comprising:

means, integrally attached to said housing, for varying said field of view;

said field of view varying means having at least two different windows, a rotatable turret containing said windows and having a rotation axis offset from and generally parallel to said field of view central axis, each said window being disposed radially from said rotation axis such that each of said windows is selectively alignable with said central axis by rotation of said turret; and means for selectively positioning said windows into and out of a generally coaxial alignment with said central axis in order to vary said field of view.

2. In an intrusion detector having a housing, means for sensing motion within at least one field of view and producing an output signal in response to said motion, means for emitting an alarm in response to said output signal from said sensing means, and means for controlling electrical operation of said intrusion detector, said field of view having a central axis, and the improvement comprising:

means for selectively varying an angle of inclination of said central axis and corresponding field of view; and said inclination angle varying means comprising a base attached to said housing and by which said detector is mountable on a support surface, said housing and base being selectively and pivotally repositionable relative to each other in order to selective vary said inclination angle.

3. The improvement as in claim 2, and further comprising:

at least one of said base and housing having an arcuate guide with a particular arc radius;

at least the other of said base and housing having an arcuate slide of arc radius generally equal to said particular arc radius and being in sliding engagement with said arcuate guide; and said sliding engagement between said guide and slide having sufficient friction for maintaining said housing in various selectable positions of tilting relative to said base.

4. The improvement as in claim 2, and further comprising:

said base being an auxiliary cradle removably attachable to said housing and by which said housing is pivotally supported and selectively repositionable relative to said base in order to vary said inclination angle.

5. In an intrusion detector having a housing, means for sensing motion within at least one field of view and producing an output signal in response to said motion, means for emitting an alarm in response to said output signal from said sensing means, and means for controlling electrical operation of said intrusion detector, said field of view having a central axis, and the improvement comprising:

means for selectively varying an angle of inclination of said central axis and corresponding field of view, and comprising:

at least one hinged cover which, in a closed position, covers said sensing means and, in a sufficiently open position, is engageable with a separate surface on which said housing is supportable during use;

a carrying strap connected to said hinged cover and being frictionally engageable between said housing and said separate surface when said cover is in said open position and said housing is supported by and tilted relative to said surface, with an angle of said tilting being defined by an angle of hinging between said housing and said cover in said open position;

whereby said strap provides sufficient friction to maintain said housing in various selectable tilted positions.

6. In an intrusion detector having a housing, means for sensing motion within at least one field of view and producing an output signal in response to said motion, means for emitting an alarm in response to said output signal from said sensing means, and means for controlling electrical operation of said intrusion detector, said field of view having a central axis, and the improvement comprising:

means, integrally attached to said housing, for varying said field of view;

said field of view varying means comprising a rotatable turret containing at least two different windows and having an axis of rotation, each said window being disposed radially from said axis of rotation such that each of said windows is selectively alignable with said central axis by rotation of said turret; and means for selectively positioning said windows into and out of a generally coaxial alignment with said central axis in order to vary said field of view.

7. The improvement as in claim 6, wherein each of said windows comprises:

optical lens means for focusing radiation from within said field of view onto said sensing means.

8. The improvement as in claim 7, wherein at least one of said optical lens means comprises:

a cluster of lenses, with each lens of said cluster being disposed laterally of each other lens of said cluster.

9. The improvement as in claim 7, and further comprising:

means for masking a portion of at least one of said windows in order to limit a size of said optical lens means and, in turn, a size of a field of view corresponding thereto.

10. The improvement as in claim 6, and further comprising:

personal emergency means providing for instant output of a high decibel alarm upon actuation of a manual switch by a user thereof;

means, upon an occurrence of said actuation, for said user to disable said alarm output and reset said personal emergency means according to a predetermined code.

11. The improvement as in claim 10, and further comprising:

said manual switch being at least one panic button; and said panic button providing said means for disabling said alarm output, wherein said predetermined code is implemented by a particular series of depressions of said panic button.

12. The improvement as in claim 6, and further comprising:

said motion sensing means having means for sensing radiation from at least two substantially different fields of view and producing said output signal in response to particular conditions of said radiation within any one or more of said fields of view.

13. The improvement as in claim 12, and said radiation sensing means comprising:

at least one passive infrared detector element.

14. The improvement as in claim 12, and said radiation sensing means comprising:

a different passive infrared detector element for each corresponding field of view.

15. The improvement as in claim 12, and further comprising:

means for defining two, generally oppositely directed, fields of view for said motion sensing means; and cover means for covering and blocking said radiation sensing for at least one of said fields of view.

16. The improvement as in claim 15, and said radiation sensing means further comprising:

a separate radiation sensing element for each of said fields of view; and a cover for each said radiation sensing element, each said cover being separately and selectively closeable in order to block use of, and provide physical protection from damage for, each said radiation sensing element.

17. The improvement as in claim 6, and further comprising:

a selectively energizable smoke detector means for detecting ambient smoke and providing another output signal in response to detection of smoke when said smoke detector means is in an energized state.

18. The improvement as in claim 6, and said alarm emitting means comprising:

means for emitting said alarm at at least two separate and different levels of volume; and means for selecting one of said volume levels to be emitted.

19. The improvement as in claim 6, and further comprising:

means, upon an occurrence of said alarm, for disabling an output of said alarm and resetting said motion sensing means into operation, said disabling and resetting means requiring a series of manual manipulations according to a predetermined reset code.

20. The improvement as in claim 6, and further comprising:

means for selectively projecting visible light from said housing and, during projection of said visible light, for indicating at least part of said field of view in order to facilitate aiming of said device.

* * * * *